US006159019A

United States Patent [19]

Norizuki et al.

[11] Patent Number: 6,159,019

[45] **Date of Patent: *Dec. 12, 2000**

[54] MOUNTING STRUCTURE FOR CONNECTOR FOR VEHICLE AND METHOD OF MOUNTING THE SAME

[75] Inventors: Teruhisa Norizuki; Shinji Kodama, both of Shizuoka-ken, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/111,040

[22] Filed: Jul. 6, 1998

[30] Foreign Application Priority Data

Jul. 7, 1997 [JP] Japan ..... P9-181262

[51] Int. Cl.[7] ..... H01R 33/00

[52] U.S. Cl. ..... 439/34; 174/72 A; 439/247; 439/248

[58] Field of Search ..... 439/34, 35, 374, 439/247, 248; 174/72 A, 72 R

[56] References Cited

U.S. PATENT DOCUMENTS

| | | | |
|---|---|---|---|
| 4,800,648 | 1/1989 | Nakayama et al. | 439/34 |
| 4,818,236 | 4/1989 | Nakayama et al. | 439/34 |
| 4,824,164 | 4/1989 | Nakayama et al. | 439/34 |
| 4,848,829 | 7/1989 | Kidd | 439/34 |
| 4,942,499 | 7/1990 | Shibata et al. | 439/34 |
| 4,943,241 | 7/1990 | Watanabe et al. | 439/34 |
| 5,460,530 | 10/1995 | Toba et al. | 439/34 |
| 5,637,019 | 6/1997 | Crane, Jr. et al. | 439/374 |
| 5,788,522 | 8/1998 | Kameyama | 439/248 |
| 5,997,328 | 12/1999 | Kodama et al. | 439/247 |

*Primary Examiner*—Paula Bradley
*Assistant Examiner*—Briggitte L. Hammond
*Attorney, Agent, or Firm*—Finnegan, Henderson, Farabow, Garrett & Dunner, L.L.P.

[57] ABSTRACT

A waterproof sheet is adhered on an inner surface of a door panel. A wire harness W is arranged on the waterproof sheet on the door panel. A first connector is connected to the wire harness. The first connector is held at a predetermined position on the door panel. A door trim is mounted to the door panel and covers the inner surface arranging the wire harness. A switch unit is mounted to the door trim. A second connector capable of fitting to the first connector is connected to the switch unit. When the switch unit is mounted to the door trim fixed to the door panel, the second connector is guided by a guide member on the door panel so as to fit to the first connector at a predetermined position. Accordingly, the connector can be easily fitted. Further, a poor connection and a disconnection of the wire harness can be securely prevented.

4 Claims, 10 Drawing Sheets

MOUNTING STRUCTURE FOR CONNECTOR FOR VEHICLE AND METHOD OF MOUNTING THE SAME

BACKGROUND OF THE INVENTION

The present invention relates to a mounting structure for a connector for a vehicle, a mounting structure thereof and a door structure of a vehicle, which are preferable for fitting and removing male and female connectors having a multiple poles.

In a conventional method of mounting a connector for a vehicle, at first, a wire harness 2 is arranged on an inner surface of a door panel 1. A waterproof sheet 1 is attached on the inner surface of the door panel 1. A connector 6 connected to the wire harness 2 is drawn out from a hole 3*a* formed on the waterproof sheet 3. A switch unit such 4 as a power window unit and the like is mounted to a door trim 5. The connector 6 of the wire harness 2 and a connector 7 of the switch unit 4 are fitted to each other. Finally, the door trim 5 is mounted to the door panel 1.

However, in the mounting method mentioned above, after the connector of the wire harness is drawn out from the hole of the waterproof sheet, the connectors are fitted to each other by a groping operation with both hands in a back surface side of the door trim in a state that the door trim before mounting is supported from a front surface side thereof. Accordingly, an operability is bad.

SUMMARY OF THE INVENTION

Accordingly, an object of the present invention is to provide a structure and a method having a good fitting operability for a connector.

In accordance with a first aspect of the present invention, there is provided a mounting structure for a connector for a vehicle, comprising:

a wire harness arranged on a waterproof sheet adhered on an inner surface of a door panel;

a first connector connected to the wire harness;

a switch unit mounted to a door trim fixed to the door panel and covering the inner surface over the wire harness; and a second connector provided to the switch unit and fitted to the first connector.

In accordance with the first aspect, since the wire harness is arranged on the waterproof sheet, it is not necessary to draw out the first connector from the portion below the waterproof sheet for fitting the first and second connectors. Accordingly, an operability of fitting the connector is improved.

Since the hole for drawing out the first connector is not formed on the waterproof sheet, a waterproof capability of the waterproof sheet itself can be well maintained.

Since the waterproof sheet is arranged outside the wire harness, a waterproofing of the wire harness is not required, so that a structure of the wire harness is made simple.

In accordance with a second aspect of the present invention, there is provided a mounting structure for a connector for a vehicle, comprising:

a wire harness arranged on an inner surface of a door panel;

a first connector connected to the wire harness;

a switch unit mounted to a door trim fixed to the door panel and covering the inner surface over the wire harness;

a second connector provided to the switch unit;

a holding member for holding the first connector at a predetermined position on the inner surface; and a guide member disposed on the door panel and guiding the second connector to be fitted to the first connector at the predetermined position when the switch unit is mounted to the door trim fixed to the door panel.

In the second aspect, at first, the wire harness having the first connector is arranged on the inner surface of the door panel. The first connector is held at a predetermined position on the inner surface by the holding member. The door trim is fixed to the door panel and covers the inner surface over the wire harness. The switch unit having the second connector is mounted to the fixed door trim. At this time, the second connector is guided to be fitted to the first connector by the guide member. Accordingly, the connector is fitted at the same time of mounting the switch unit. Therefore, the connector can be fitted by a single hand with ease and for a short time, so that an operability of fitting the connector is improved.

In the case that the connector is fitted in a state that the door panel and the door trim are separated, the wire harness requires a drawing out portion for approaching the first connector to the second connector, so that the wire harness necessarily becomes long. On the contrary, in the second aspect, since the connector is fitted by mounting the switch unit to the door trim in a state that the door trim is mounted to the door panel, the drawing out portion mentioned above is unnecessary. Accordingly, the wire harness is made short and a cost is reduced.

In accordance with the second aspect, the connector is fitted after the door trim is mounted to the door panel, and the wire harness is made short. Accordingly, the wire harness is never meshed between the door trim and the door panel, so that a poor connection and a disconnection of the wire harness are securely prevented.

In accordance with a third aspect of the present invention, there is provided a method of mounting a connector for a vehicle, comprising the steps of:

arranging a wire harness having a first connector on a waterproof sheet adhered on an inner surface of a door panel; and mounting a switch unit having a second connector to a door trim fixed to the door panel and covering the inner surface over the wire harness; and fitting the second connector to the first connector.

In accordance with the third aspect, since the wire harness is arranged on the waterproof sheet, it is not necessary to draw out the first connector from the portion below the waterproof sheet for fitting the first and second connectors. Accordingly, an operability of fitting the connector is improved.

Since the hole for drawing out the first connector is not formed on the waterproof sheet, a waterproof capability of the waterproof sheet itself can be well maintained.

Since the waterproof sheet is arranged outside the wire harness, a waterproofing of the wire harness is not required, so that a structure of the wire harness is made simple.

A fitting of the connector is performed at a time of mounting the switch unit to the door trim fixed to the door panel, or thereafter. Accordingly, it is not necessary to support the door panel at a time of fitting the connector, so that an operability of fitting the connector can be improved. Further, a meshing of the wire harness is prevented, so that a poor connection and a disconnection of the wire harness can be securely prevented.

BRIEF DESCRIPTION OF THE DRAWINGS

FIG. 11 is an exposed perspective view of a conventional structure.

DESCRIPTION OF THE PREFERRED EMBODIMENTS

An embodiment of the present invention will be described low with reference to the drawings.

Figure 1:
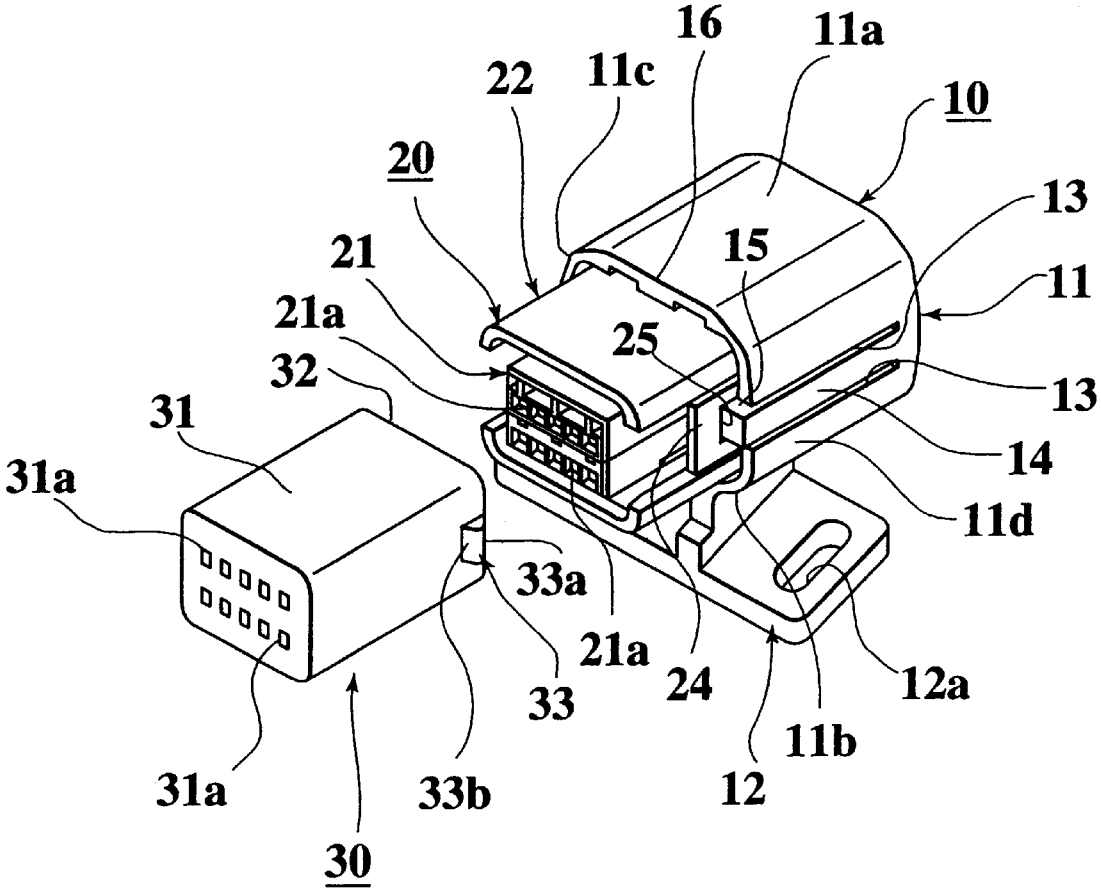
FIG. 1 is a perspective view which shows a state of male and female connectors used for a mounting structure in accordance with an embodiment of the present invention before fitting.
Figure 3:
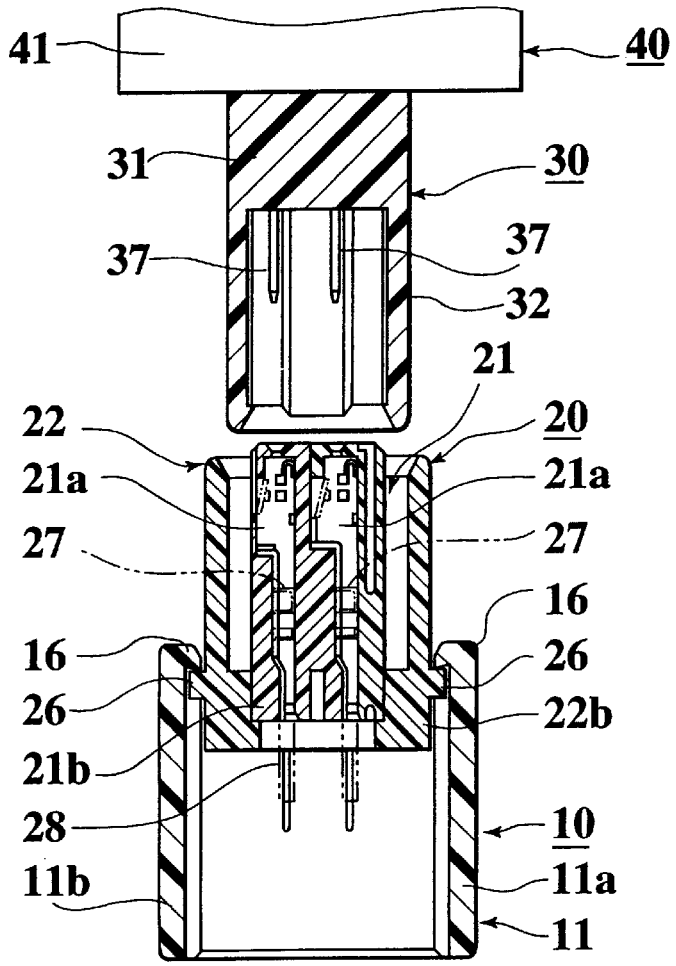
FIG. 3 is a cross sectional view which shows the connector in FIG. 1 before fitting.
Figure 7:
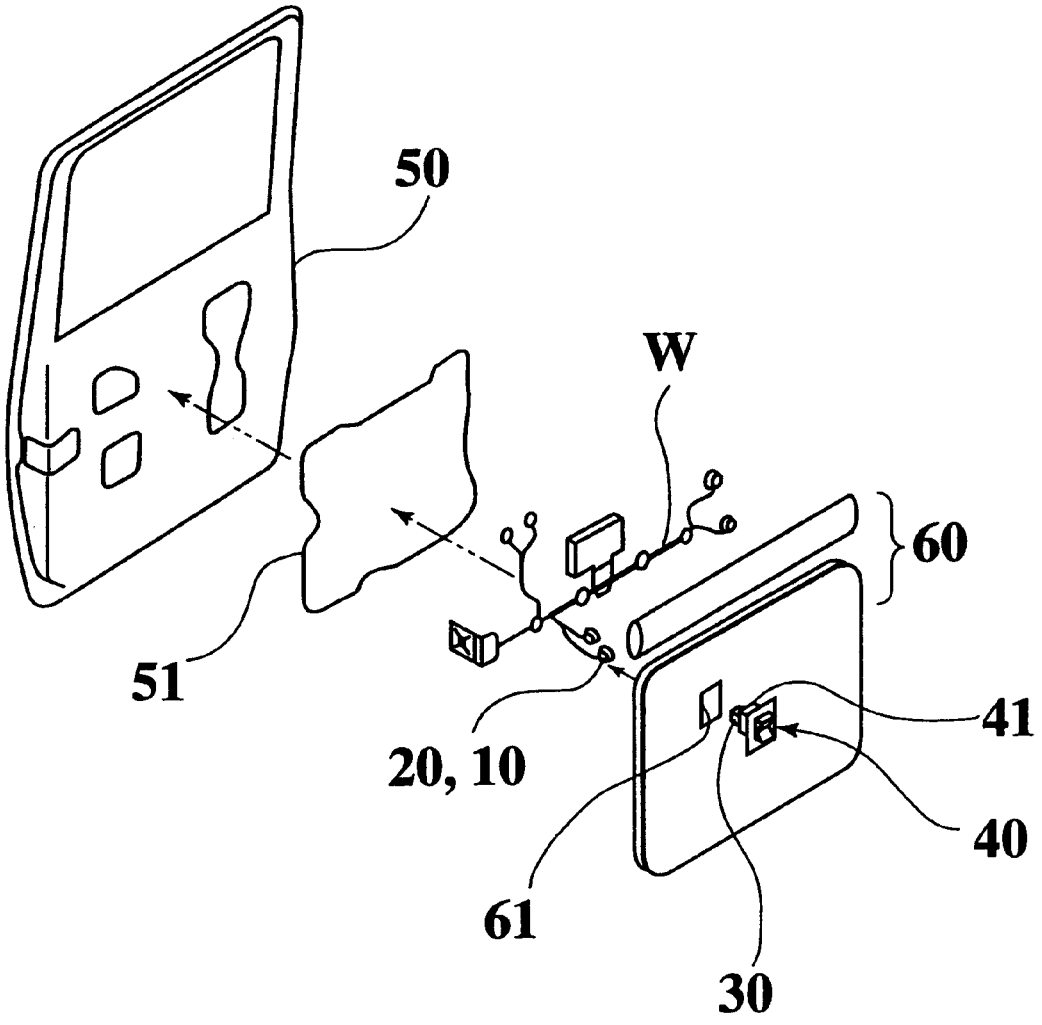
FIG. 7 is an exploded perspective view of a door for a vehicle using the connector in FIG. 1.
Figure 8:
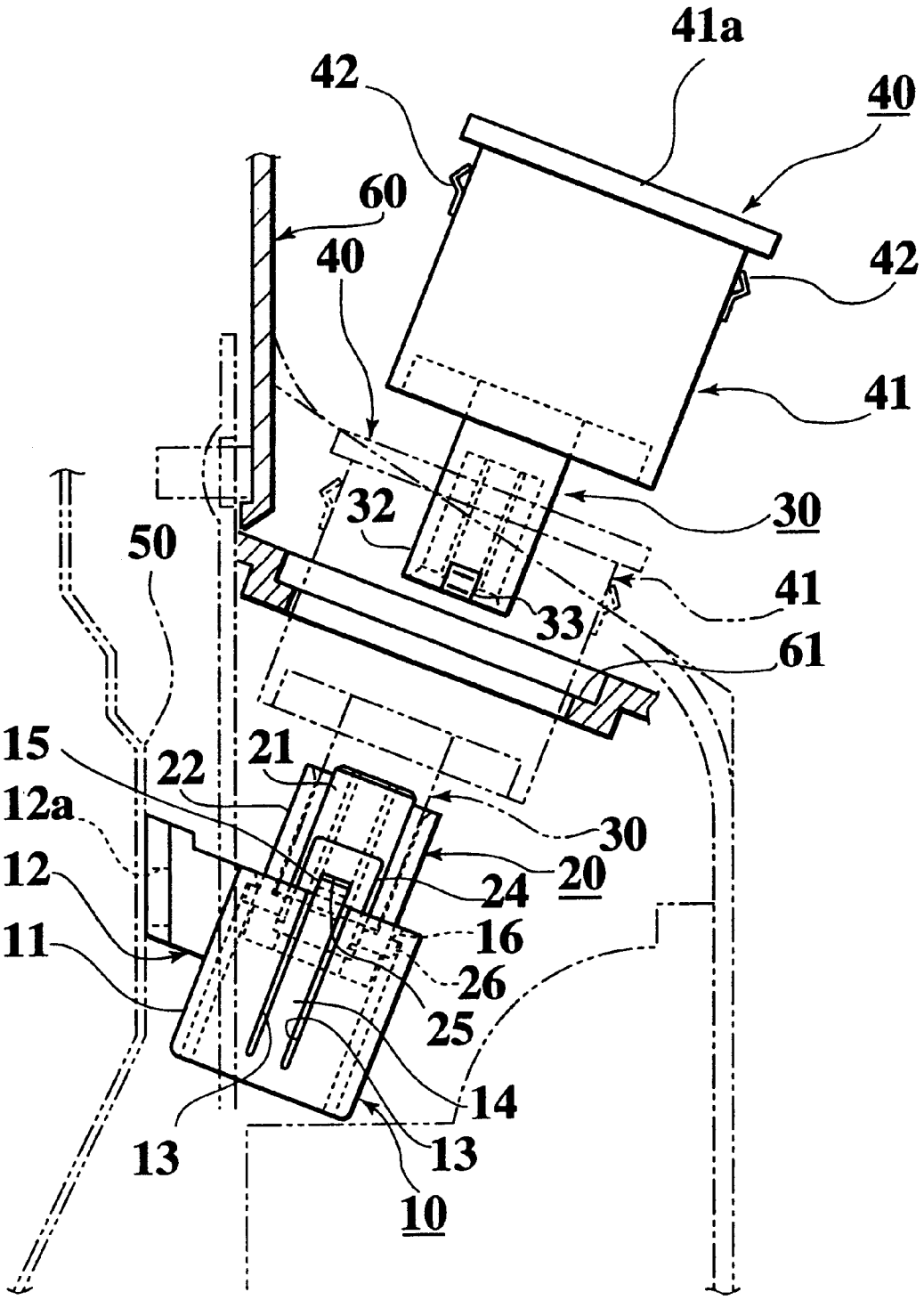
FIG. 8 is a schematic view which shows the connector in FIG. 7 before fitting.

FIG. 1 is a perspective view which shows a state of male and female connectors used for a mounting structure of an embodiment of the present invention before fitting, FIG. 3 is a cross sectional view which shows the male and female connectors before fitting, FIG. 7 is an exploded perspective view of a door for a vehicle using the connector in FIG. 1, and FIG. 8 is a schematic view which shows the male and female connectors of the door for the vehicle before fitting.

At first, a structure of the connector and the like used in this embodiment will be described.

As shown in FIGS. 1 and 8, a male connector (a first connector) 20 is mounted to a door panel 50 through a synthetic resin holder 10 in a projecting and waiting state. A synthetic resin female connector (a second connector) 30 is freely fit to the male connector 20 projecting from the holder 10 and waiting. The female connector 30 is mounted to a switch 41 of a switch unit 40 such as a switch unit for a power window and the like through a base plate and the like (not shown). The switch unit 40 is mounted to the switch mounting hole 61 formed in a door trim 60.

Figure 4:
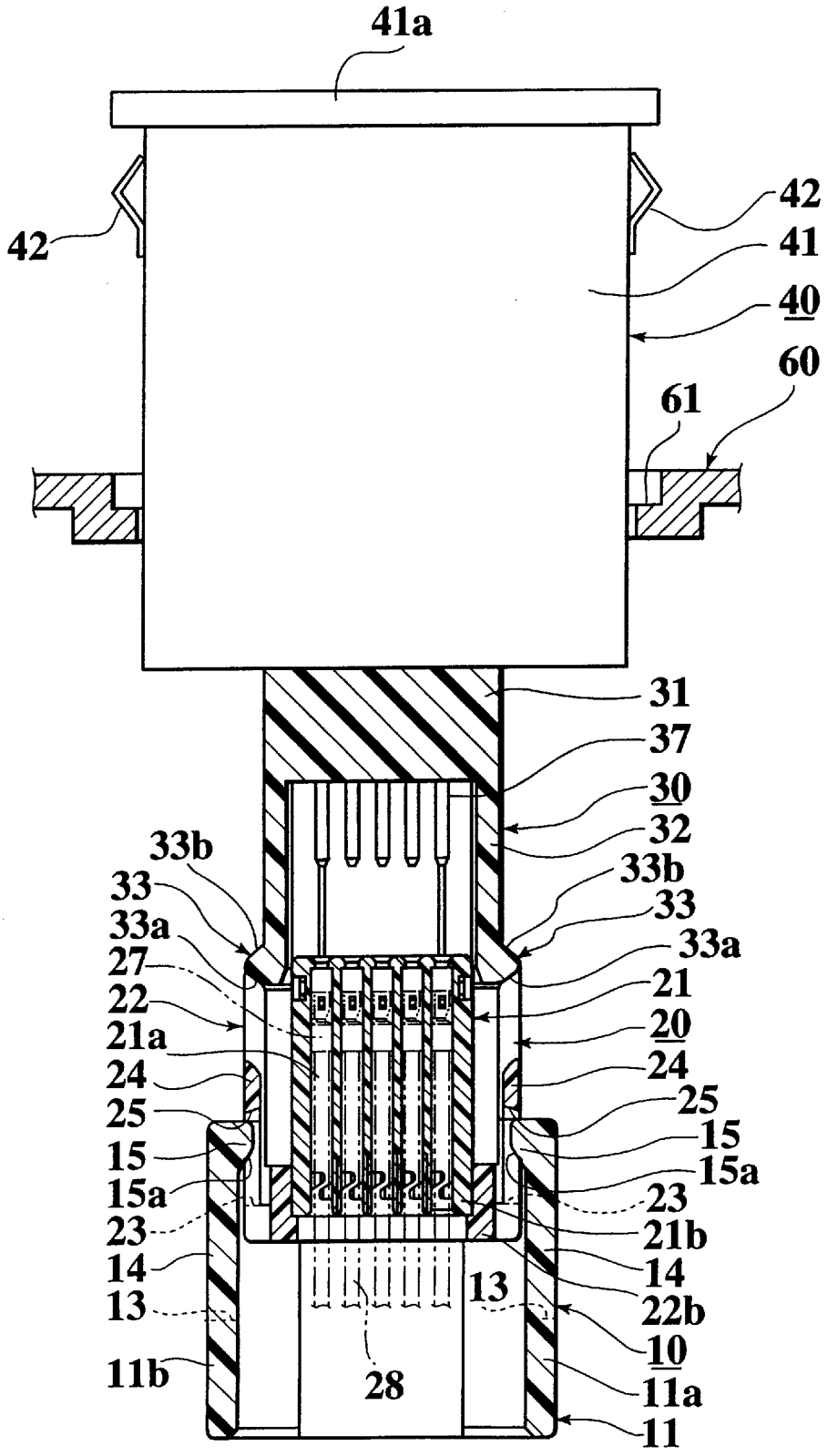
FIG. 4 is a cross sectional view which shows a state of the connector in FIG. 1 at the early time of fitting.

As shown in FIGS. 1, 3 and 4, the holder 10 is constituted by a cylindrical body 11 and a mounting bracket 12. The cylindrical body 11 is formed in a substantially rectangular cylindrical shape and has upper and lower walls 11*a* and 11*b*, and left and right side walls 11*c* and 11*d*. The mounting bracket 12 integrally projects from the lower wall 11*b* of the cylindrical body 11.

A pair of slits 13 and 13 are formed in the center of the left and right side walls 11*c* and 11*d* of the cylindrical body 11, respectively. L-shaped flexible arms 14 integrally project from a portion between the pair of slits 13 and 13, respectively. As shown in FIG. 4, projections 15 having a trapezoidal cross section integrally project from an inner side of a tip of the pair of flexible arms 14 and 14, respectively. A taper surface 15*a* is formed in a rear portion of each of the projection 15.

As shown in FIG. 3, a pair of stoppers 16 and 16 for restricting a forward projecting amount of the male connector 20 integrally project from a center of a front edge end of the inner surface of the upper and lower walls 11*a* and 11*b* in the cylindrical body 11 of the holder 10. A clearance is provided along all the periphery between the cylindrical body 11 of the holder 10 and a below-mentioned hood 22 of the male connector 20. The hood 22 of the male connector 20 is slidably supported within the cylindrical body 11 of the holder 10. The fitted male connector 20 and female connector 30 are supported to the hood 22.

Figure 2:
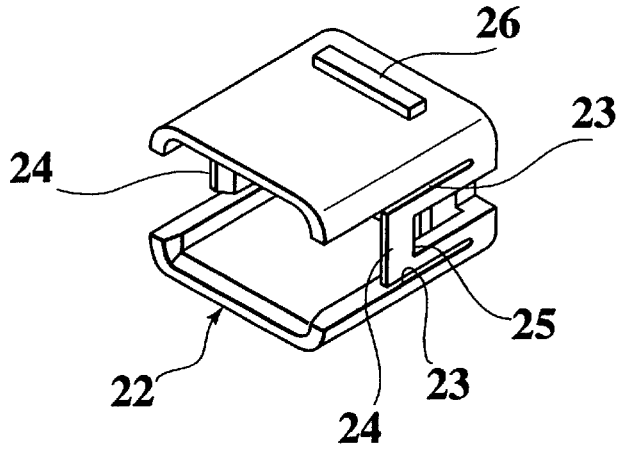
FIG. 2 is a perspective view of a hood of the male connector in FIG. 1.

As shown in FIGS. 1 and 3 to 6, the male connector 20 is constituted by a housing 21 having a plurality of contact receiving chamber 21*a* receiving a female contact 27, and the hood 22 covering the housing 21. A base portion 21*b* of the housing 21 is assembled to a base portion 22*b* of the hood 22 by a press fitting or the like. As shown in FIGS. 1 and 2, the hood 22 is formed in a substantially rectangular cylindrical shape from the upper and lower walls and the left and right side walls. The hood 22 serves as a guide for the holder 10 and the female connector 30. A pair of slits 23 and 23 are formed in each of the center in the left and right side walls of the substantially rectangular cylindrical hood 22. An U-shaped flexible locking piece 24 is integrally formed between each pair of slits 23 and 23, respectively. Each of the flexible locking pieces 24 has an engaging hole 25 engageable with the projection 15 of each of the flexible arms 14 in the holder 10. A width of each of the flexible locking pieces 24 is set to be larger than a width of the projection 15 of each of the flexible arm 14 in the holder 10. Each of the flexible locking piece 24 is disposed in such a manner as to be in contact with the left and right side walls 11*c* and 11*d* near each of the flexible arms 14 of the cylindrical body 11 in the holder 10.

As shown in FIG. 4, at a time of engagement between the projection 15 of the holder 10 and the engaging hole 25 of the hood 22, the male connector 20 projects from the holder at a predetermined length and waits until the female connector 30 is fitted thereto. Accordingly, a backward movement of the male connector 20 is restricted with respect to the holder 10 by a locking between the projection 15 and the engaging hole 25 so as to be maintained at a predetermined position. This predetermined position becomes a fitting position between the connectors 20 and 30.

As shown in FIGS. 2 and 3, stopper receiving portions 26 are integrally projected in the center of the base portion of the upper and lower walls in the hood 22 of the male connector 20. At a time of locking between the projection 15 of the holder 10 and the engaging hole 25 of the hood 22, each of the stopper receiving portions 26 of the hood 22 in the male connector 20 is locked with each of the stoppers 16 of the cylindrical body 11 in the holder 10, respectively, so that the forward projecting amount of the male connector 20 is restricted.

As shown in FIGS. 3 and 7, a wire 28 constituting a wire harness W is connected to a rear side of each of the female contacts 27 of the housing 21 in the male connector 20 by a pressure welding or a pressure connection.

As shown in FIGS. 1 and 4 to 6, the female connector 30 has a block-shaped base portion 31 including a plurality of contact receiving chambers 31*a* receiving male contacts 37. A rectangular cylindrical hood portion 32 integrally projecting from the base portion 31 is formed in the front side of the female connector 30. Each of the male contacts 37 exposes within the hood portion 32. At a time of fitting between the connectors 20 and 30, the hood portion 32 is inserted between the housing 21 and the hood 22 of the male connector 20, and the respective contacts 27 and 37 of the connectors 20 and 30 are electrically connected to each other. The projections 33 integrally projects from the center of the front side in the both side outer surfaces of the hood portion 32 in the female connector 30, respectively. The projections 33 hold a locking state between the projection 15 of the holder 10 and the engaging hole 25 of the male connector 20. Further, the projections 33 cancels a locking state between the projection 15 of the holder 10 and the engaging hole 25 of the male connector 20 at a time when the fitting between the connectors 20 and 30 is completed and removed. Each of the projections 33 is formed in a substantially triangular shape, and has taper surfaces 33*a* and 33*b* in the front side and the rear side thereof.

Figure 6:
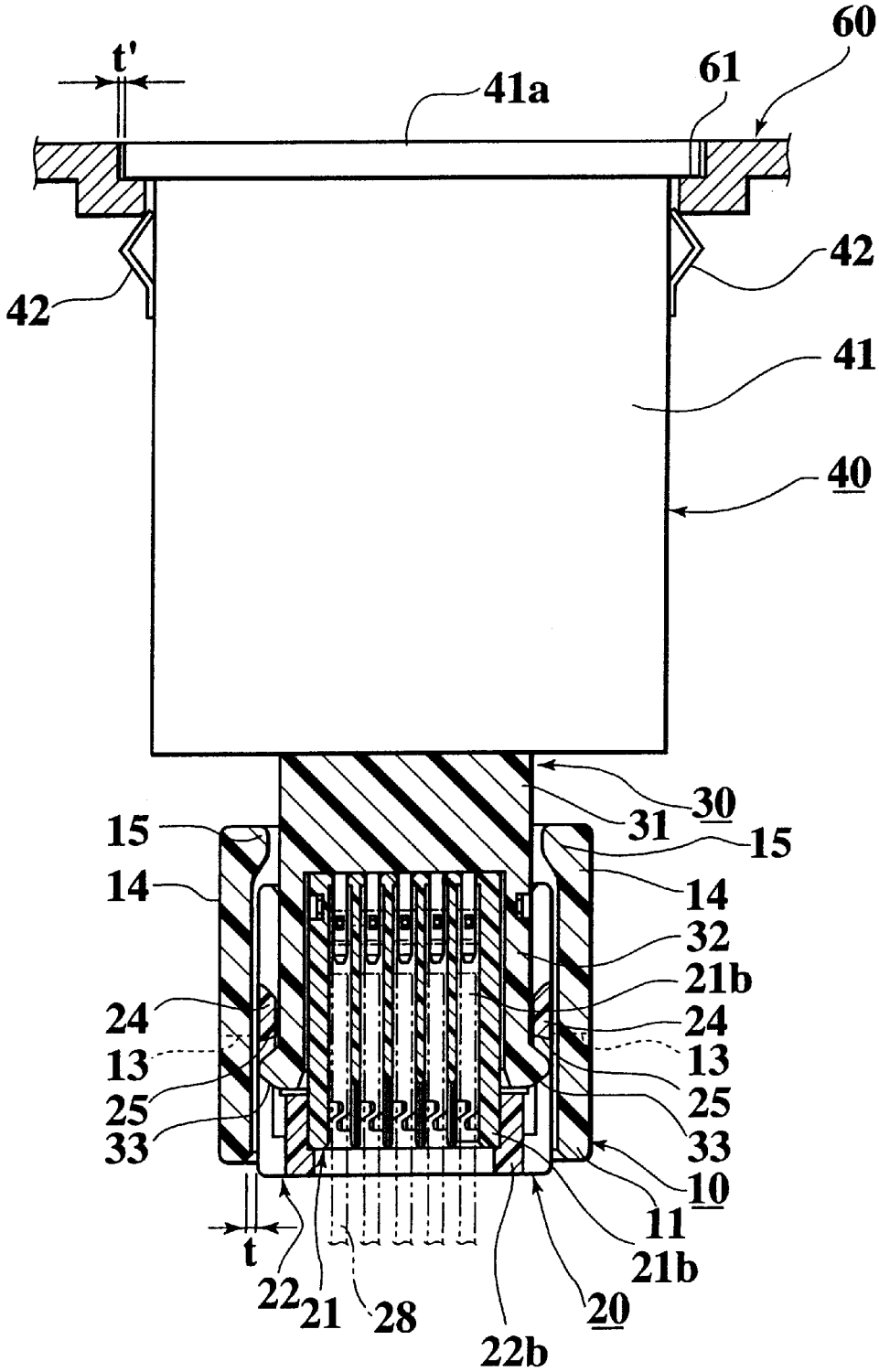
FIG. 6 is a cross sectional view which shows a fitting completing state of the connector in FIG. 1.

As shown in FIGS. 4 and 6 to 10, the switch unit 40 is constituted by a switch 41, the female connector 30 and two sheets of plate springs 42. The female connector 30 is fixed to the switch 41 through a base plate (not shown). The plate spring 42 made of an L-bent metal plate, and is mounted to an upper side of both side surfaces of the switch 41 by screwing or the like. The plate spring 42 locks the switch 41 mounted to the switch mounting hole 51 of the door trim 60 to the door trim 60. As shown in FIG. 6, a clearance t1 between the cylindrical body 11 of the holder 10 and the hood 22 of the male connector 20 is set to be larger than a mounting clearance t2 between the switch 41 of the switch unit 40 and the switch mounting hole 61 of the door trim 60 (t1>t2). A waterproof sheet 51 is attached to the door panel 50.

Next, a method of mounting the connector for the vehicle will be described below with reference to FIG. 7.

As shown in FIG. 7, in the case of connecting the male connector 20 of the wire harness W to the female connector 30 of the switch unit 40, at first, the waterproof sheet 51 is attached to the door panel 50. The wire harness W is arranged to the door panel 50 over the waterproof sheet 51. The door trim 60 is mounted to the door panel 50 in which the wire harness W is arranged. The female connector 30 of the switch unit 40 is mounted to the switch mounting hole 61 of the door trim 60. The female connector 30 and the male connector connected to the end portion of the wire harness W are fitted to each other.

Figure 9:
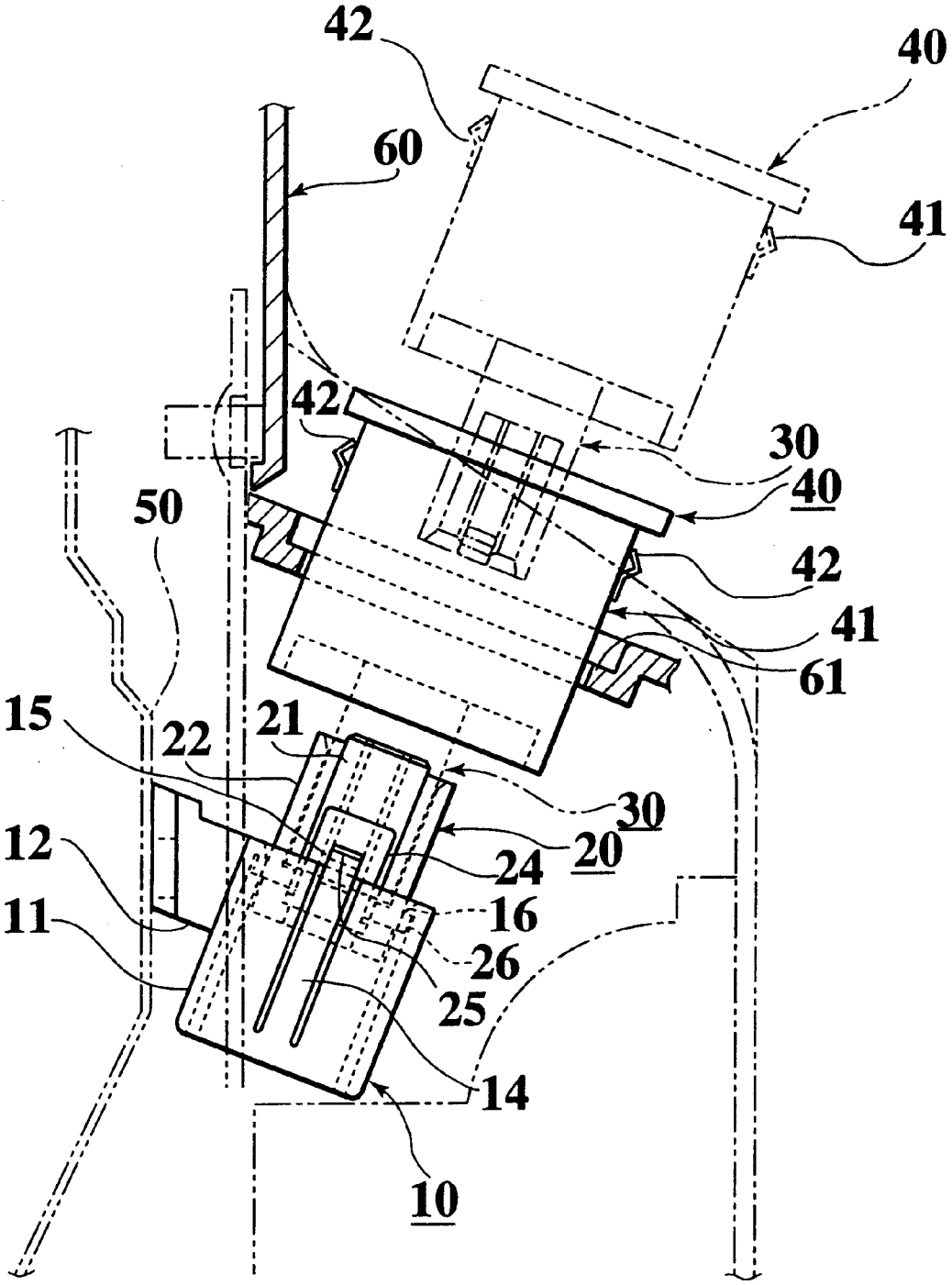
FIG. 9 is a schematic view which shows the connector in FIG. 7 at a time of completing a fitting.
Figure 10:
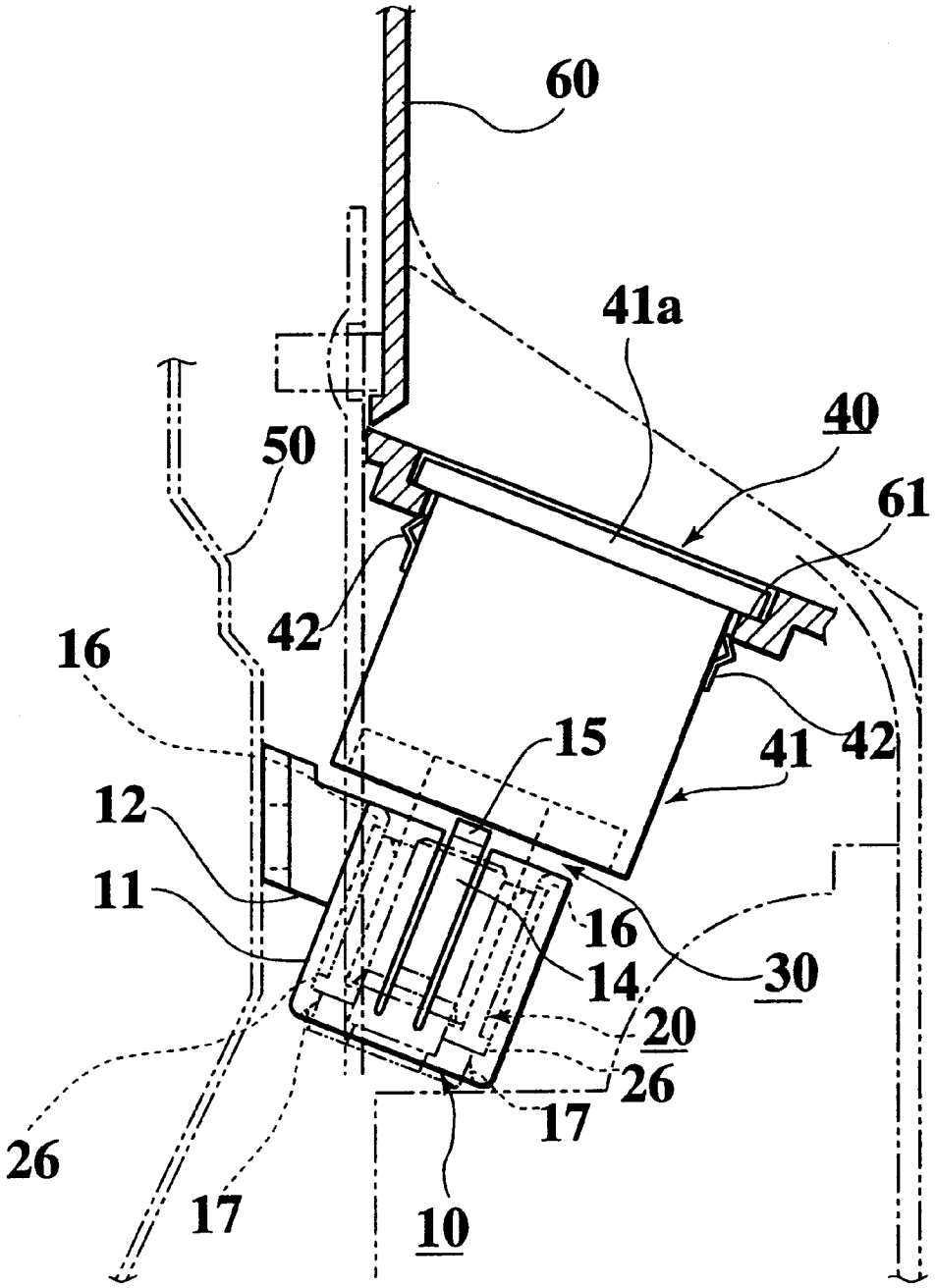
FIG. 10 is a schematic view which shows a mounting completing state of the switch unit in FIG. 7.
Figure 11:
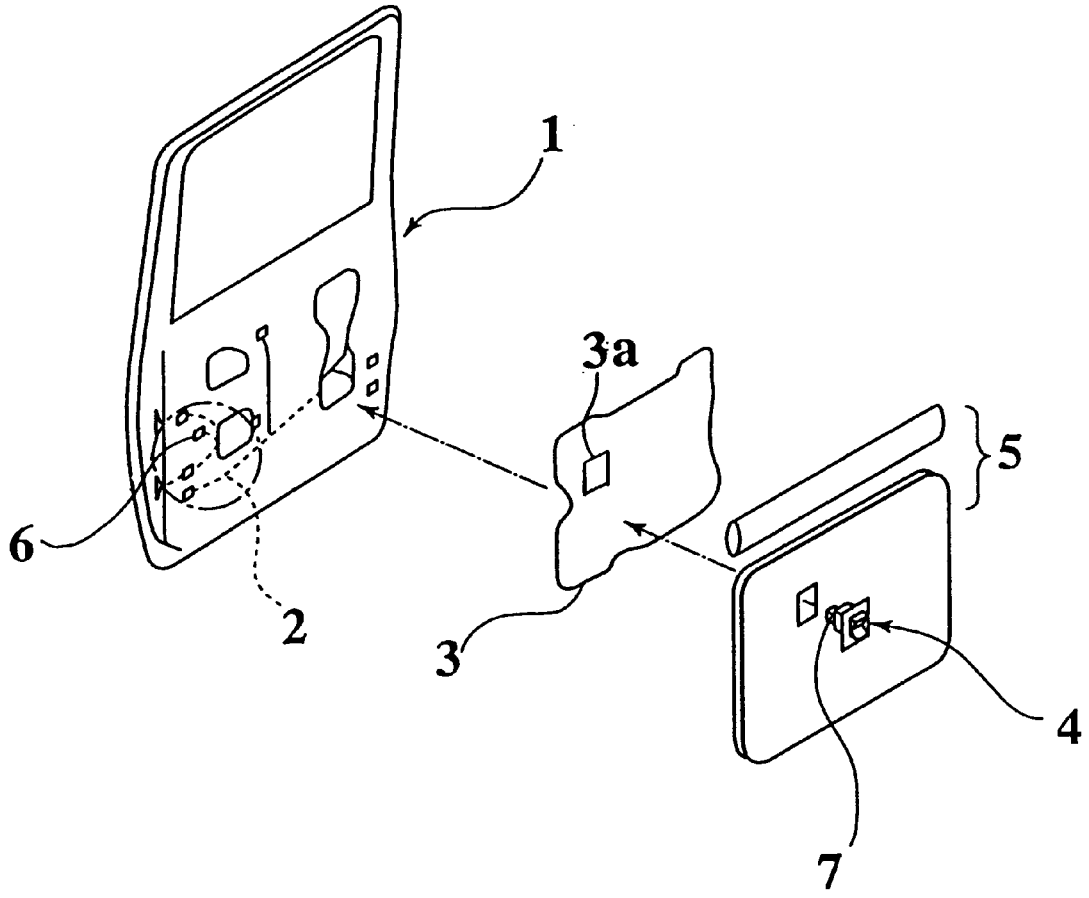
FIG.11 PRIOR ART
FIG. 11 is a perspective view which shows a segmented diagram of a conventional vehicle door.

In this case, as shown in FIGS. 8 to 10, the male connector 20 of the wire harness W end is mounted to the door panel 50 through the holder 10, and the male connector 20 is made wait in such a manner as to project to the switch mounting hole 61 of the door trim 60. Accordingly, at a time of mounting the switch unit 40 to the switch mounting hole 61, the female connector 30 of the switch unit 40 end and the male connector 20 of the wire harness W end are fitted to each other.

Figure 5:
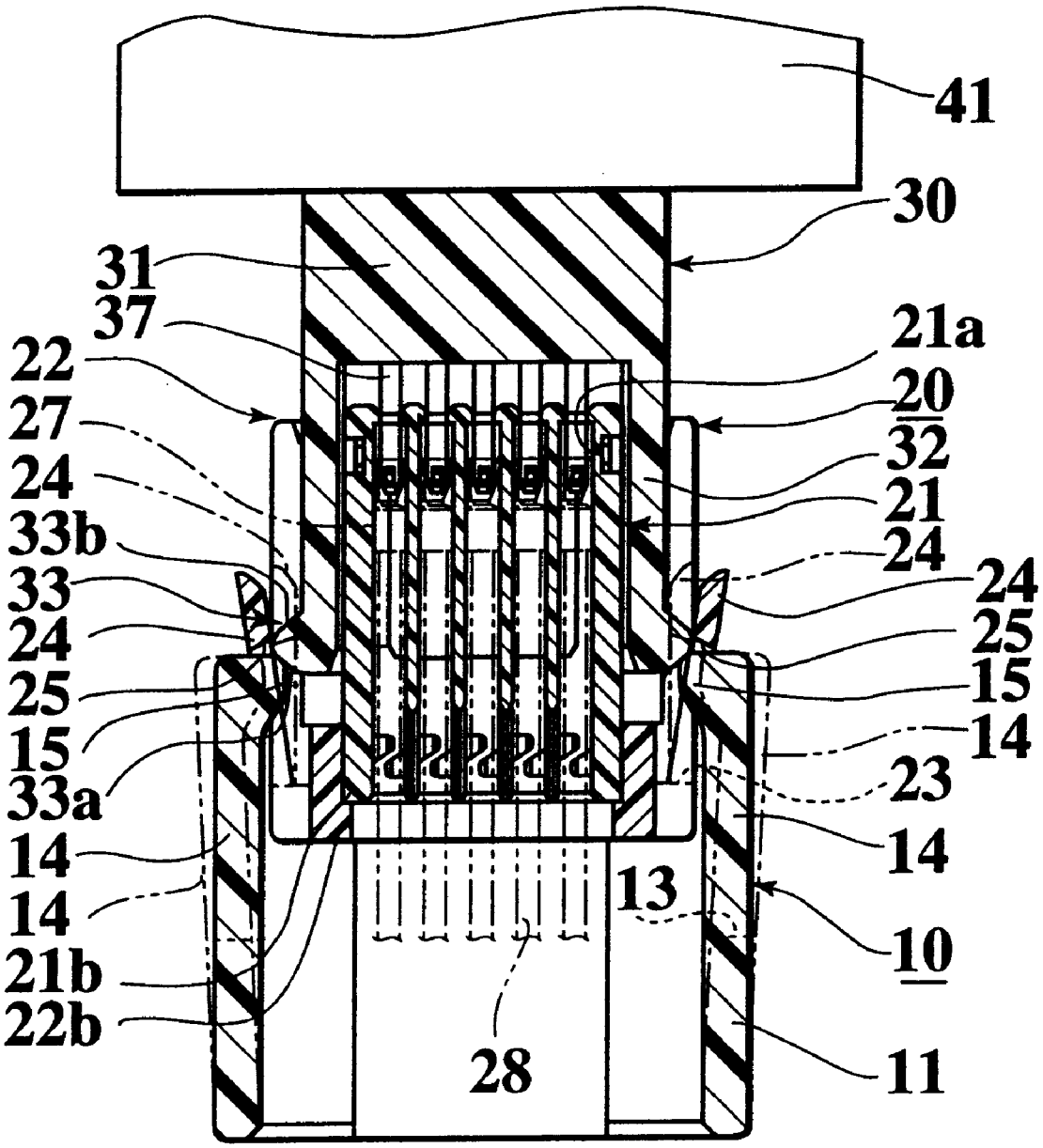
FIG. 5 is a cross sectional view which shows a state of the connector in FIG. 1 in the middle of fitting.

A fitting between the connectors 20 and 30 will be described below with reference to FIGS. 4 to 6. As shown in FIG. 4, at an initial state, a waiting state for a projection of the male connector 20 is held by a locking between the projection 15 of the holder 10 and the engaging hole 25 of the male connector 20. As shown in FIG. 5, in the middle of the fitting, each of the flexible locking pieces 24 of the male connector 20 elastically deforms outward due to a pressing force of each of the projections 33 in the female connector 30, so that a locking between the projection 15 of the holder 10 and the engaging hole 25 of the male connector 20 can be more securely maintained. As shown in FIG. 6, when a fitting between the connectors 20 and 30 is completed, each of the projections 33 in the female connector 30 enters into the engaging hole 25 in the male connector 20. Accordingly, a locking between the projection 15 and the engaging hole 25 is canceled, the completely fitted connectors 20 and 30 downward slide within the holder 10. When the sliding is completed, as shown in FIG. 6, the switch 41 mounted within the switch mounting hole 61 of the door trim 60 is locked by an elastic urging force of the plate spring 42. As mentioned above, the mounting operation of the switch unit 40 to the door panel 50 and the fitting operation of the connectors 20 and 30 are completed.

As mentioned above, in accordance with this embodiment, the waterproof sheet 51 is attached to the door panel 50, the wire harness W is arranged to the door panel 50 over the waterproof sheet 51, the door trim 60 is mounted to the door panel 50, and the switch unit 40 is mounted to the door trim 60, and at the same time, the female connector 30 of the switch unit 40 and the male connector 20 of the wire harness W are easily fitted to each other. Accordingly, the fitting operation between the connectors 20 and 30 can be performed by a single hand with ease and for a short time.

In the case that the connectors are fitted in a state that the door panel and the door trim are separated, it is necessary to perform a fitting operation between the connectors with supporting the door trim. On the contrary, in accordance with this embodiment, it is unnecessary to perform a fitting operation with supporting the door trim 60.

In this embodiment, since the wire harness W is arranged over the waterproof sheet 51, it is unnecessary to draw out the male connector 20 from the below portion of the waterproof sheet 51 so as to fit the connectors 20 and 30 to each other.

As a result, a fitting operability between the connectors 20 and 30 can be improved.

In the case that the connectors are fitted in a state that the door panel and the door trim are separated, a drawing out portion for approaching the male connector to the female connector of the switch unit is required for the wire harness, so that the wire harness necessarily becomes long. On the contrary, in this embodiment, since the connectors 20 and 30 are fitted by mounting the switch unit 40 to the door trim 60 in a state that the door trim 60 is mounted to the door panel 50, the drawing out portion is unnecessary. Accordingly, the wire harness W is made short, and a cost is reduced.

In accordance with this embodiment, the connectors 20 and 30 are fitted after the door trim 60 is mounted to the door panel 50, and the wire harness W is made short. Accordingly, the wire harness W is never meshed between the door trim 60 and the door panel 50, so that a poor connection and a disconnection of the wire harness W can be securely prevented.

Since a hole for drawing out the male connector 20 is not formed on the waterproof sheet 51, a waterproof capability of the waterproof sheet 51 itself can be well maintained.

Since the waterproof sheet 51 is arranged outside the wire harness W, a waterproof process is not required with respect to the wire harness W. Accordingly, a structure of the wire harness W can be made simple and a cost can be reduced.

What is claimed is:

1. A mounting structure for a connector for a vehicle, the mounting structure comprising:

a waterproof sheet adhered on an inner surface of a door panel;

a wire harness on the waterproof sheet;

a first connector connected to the wire harness, the first connector including a holder on the inner surface of the door panel at a predetermined position, a guide member slidably coupled to the holder, said guide member being movable between a first position projecting from the holder and a second position substantially within the holder, wherein said guide member includes a flexible portion configured to flex outwardly with respect to the holder, and a housing coupled to the guide member;

a door trim with a hole, the door trim being fixed on the door panel so that the door trim covers at least a portion of the inner surface and the wire harness, the hole facing the first connector when the door trim is fixed on the door panel;

a switch unit mounted on the door trim; and a second connector provided on the switch unit, the second connector being configured to engage the first connector and being capable of being inserted into the hole of the door trim when the switch unit is mounted on the door trim, wherein said flexible portion of the guide member flexes outwardly to guide the first connector into slide contact with the second connector so that the second connector engages the first connector when the second connector is inserted into the hole of the door trim.

2. The mounting structure of claim 1, wherein said flexible portion includes an engagement hole and said second connector includes a projection, and wherein said projection engages said engagement hole when the guide member is in the second position.

3. A method of mounting a connector for a vehicle, the method comprising the steps of:

adhering a waterproof sheet on an inner surface of a door panel;

positioning a wire harness on the waterproof sheet, the wire harness having a first connector;

holding the first connector at a predetermined position on the inner surface of the door panel, the first connector including a holder on the inner surface of the door panel at a predetermined position, a guide member slidably coupled to the holder, said guide member being movable between a first position projecting from the holder and a second position substantially within the holder, wherein said guide member includes a flexible portion configured to flex outwardly with respect to the holder, and a housing coupled to the guide member;

fixing a door trim on the door panel, the door trim covering at least a portion of the inner surface and the wire harness, the door trim having a hole that faces the first connector; and inserting a second connector of a switch unit through the hole of the door trim with the guide member in the first position, wherein said flexible portion of the guide member flexes outwardly to guide the first connector into slide contact with the second connector so that the second connector engages the first connector.

4. The method of claim 3, wherein said flexible portion includes an engagement hole and said second connector includes a projection, and wherein the inserting of the second connector through the hole includes moving the guide member from the first position to the second position so that said projection engages said engagement hole.

* * * * *